United States Patent [19]

Stiltz et al.

[11] 4,113,035

[45] Sep. 12, 1978

[54] HAMMER DRILL WITH DRIVE AND PERCUSSION ELEMENTS ACCOMMODATED IN A CYLINDER

[75] Inventors: Erwin Stiltz, Winnenden-Schelmenholz; Rudolf Hoyer, Althütte; Heinz Lindenmayer, Hegnach, all of Germany

[73] Assignee: Licentia Patent-Verwaltungs-G.m.b.H., Germany

[21] Appl. No.: 789,680

[22] Filed: Apr. 21, 1977

[51] Int. Cl.[2] ..... B25D 9/00

[52] U.S. Cl. ..... 173/116; 173/104

[58] Field of Search ..... 173/14, 104, 105, 116–118, 173/DIG. 2

[56] References Cited

U.S. PATENT DOCUMENTS

| | | | |
|---|---|---|---|
| 2,918,312 | 12/1959 | Filstrup | 285/349 X |
| 3,929,195 | 12/1975 | Stiltz et al. | 173/116 |

FOREIGN PATENT DOCUMENTS

| | | | |
|---|---|---|---|
| 2,303,643 | 10/1976 | France | 173/DIG. 3 |
| 2,251,247 | 5/1974 | Fed. Rep. of Germany | 173/118 |
| 2,364,236 | 6/1975 | Fed. Rep. of Germany | 173/116 |
| 2,407,879 | 8/1975 | Fed. Rep. of Germany | 173/116 |
| 2,439,039 | 2/1976 | Fed. Rep. of Germany | 173/116 |

*Primary Examiner*—Lawrence J. Staab

*Attorney, Agent, or Firm*—McGlew and Tuttle

[57] ABSTRACT

A hammer drill comprises a housing with a cylinder in the housing defining a cylindrical piston chamber and an air chamber located around at least a portion of the piston chamber sealed against the ambient atmosphere and against adjacent components of the housing. The housing defines a tool-receiving chamber aligned with and communicating with the piston chamber and a percussion body is movable in a piston chamber against a tool positioned in the tool-receiving chamber. The piston is reciprocated through a crank drive by an electric motor within the housing toward and away from a percussion body. The cylinder defines a pneumatic buffer zone between the piston and the percussion body so that air which is displaced by the movement of the piston provides a coupling and buffing fluid between the piston and the percussion body. The cylinder is provided with a first air passage opening which communicates with the air chamber and the buffer zone, and it is spaced from the piston when the piston is in a forward dead-center position. The housing has a collar-receiving recess and a radially extending annular collar-shaped shoulder is defined on the cylinder and it extends into the recess. The collar is provided with air passages therethrough, and it determines the spatial position of the cylinder in the housing. The housing and the cylinder are in form-locked interengagement.

7 Claims, 3 Drawing Figures

HAMMER DRILL WITH DRIVE AND PERCUSSION ELEMENTS ACCOMMODATED IN A CYLINDER

FIELD AND BACKGROUND OF THE INVENTION

This invention relates in general to the construction of drills and, in particular, to a new and useful hammer drill in which a percussion body is driven by a reciprocating piston through an intermediate pneumatic buffer zone, and a cylinder, forming the space for the movement of the percussion body and piston and the buffer zone, includes a collar, which is held between the housing parts, and is provided with air passages therethrough which communicate the interior of the cylinder with an air passage surrounding the cylinder in the housing which is sealed from adjacent components of the housing and from the ambient atmosphere.

DESCRIPTION OF THE PRIOR ART

This invention is an improvement over the invention disclosed and described in U.S. Pat. application Ser. No. 739,026, filed on Nov. 7, 1976. The patent application relates to a drill hammer having its drive and percussion elements in the form of a motor driven piston and a free percussion body accommodated in a common cylinder. In the previous construction, the percussion body is reciprocated by the piston, with air as the coupling and buffer fluid, and the control of the reciprocating motion is effected through an air passage opening which is provided in the cylinder wall in the pneumatic buffer zone. The air passage opening, or a plurality of openings, are provided in the buffer zone at a location which is clearly spaced from the piston in the forward dead-center position thereof, and establishes communication between the cylinder space and a chamber which surrounds the cylinder at least partly and is secluded from the outside and the adjacent spaces and component parts of the hammer.

SUMMARY OF THE INVENTION

The present invention is directed to a drill hammer in which the conditions for mounting and dismounting of the drive mechanism are improved so that, in both instances, material and working time is saved. In addition, the chamber serving the purpose of equalizing the air pressure is still more effectively sealed off, and the spindle sleeve and the gear which is integral with the sleeve are mounted in an optimum shockabsorbing manner.

In accordance with the invention, the wall of the cylinder is provided on its outer surface with a collar-shaped shoulder which has air passage openings and which determines the spatial position of the cylinder in the hammer housing. The cylinder is inserted in a receiving part so as to be form-locked and secured against rotation. It has been found advantageous to provide ribs in the rear part of the housing associated with the cylinder and by which the cylinder is centered. In accordance with a further feature of the invention, the shoulder surrounds the cylinder concentrically and is provided with a plurality of bores distributed along its circumference and extending axially, which establish air passages between the tool-side zone of the hammer and the rear zone.

Accordingly, it is an object of the invention to provide an improved hammer drill in which a motor driven piston reciprocates in a cylinder to displace a percussion body by the coupling of an intermediate air space therebetween, and wherein an air chamber is defined in the housing surrounding the cylinder, containing the percussion body and the piston, and which is locked in position in the housing and includes a collar having axial air flow passages therein for communicating with an air chamber defined around the cylinder.

A further object of the invention is to provide a hammer drill which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawings and descriptive matter in which there is illustrated a preferred embodiment of the invention.

DESCRIPTION OF THE PREFERRED EMBODIMENT

Figure 1:
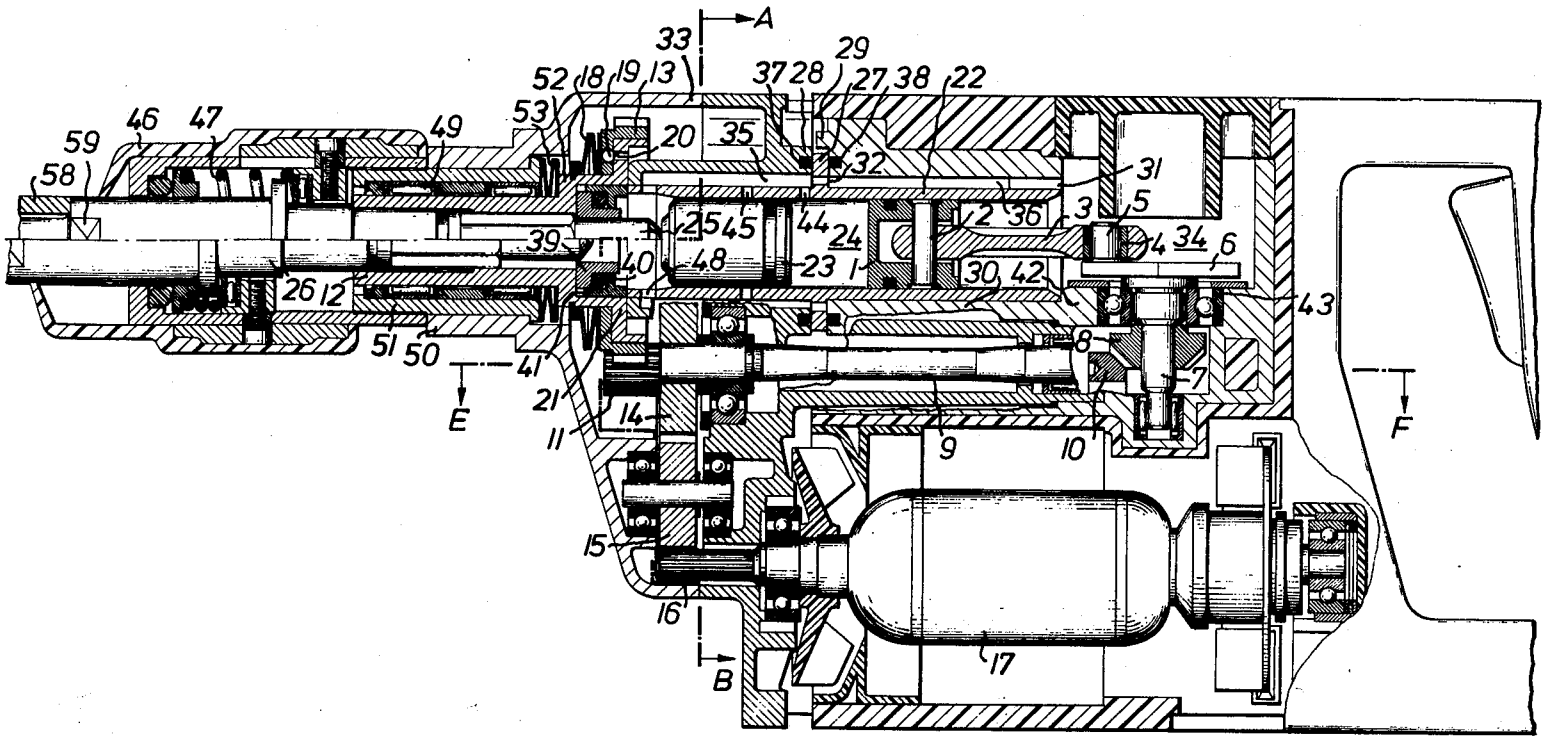
FIG. 1 is a partial longitudinal sectional view of a hammer drill construction in accordance with the invention and taken along line C–D of FIG. 2.

Referring to the drawings in particular, the embodiment of the invention embodied shown therein comprises a hammer drill which is shown in FIG. 1, and which includes a working piston 1, driven through a piston pin 2 and a connecting rod 3 acting thereon. An eccentric pin 5 of a crank 6 is engaged in a rear bearing 4 of connecting rod 3, and the shaft 7 of crank 6 carries a gear 8 which meshes with a gear 10 mounted on an intermediate shaft 9. On its tool-side end portion, intermediate shaft 9 carries a pinion 11 meshing with, and thereby driving, a gear 13, which is integral with a spindle sleeve 12. Intermediate shaft 9 further carries a gear 14 meshing with an idler gear 15 which is driven by an armature pinion 16 of a drive motor 17.

A safety clutch is provided within drill spindle gear 13, having the form of several balls 19 which are biased by cup springs 18 and associated with bores 20 which are provided in an enlarged flange portion 21 of spindle sleeve 12. This safety clutch disengages drive gear 13 from spindle 12 as soon as the load moment acting on the spindle sleeve exceeds a predetermined value.

Working piston 1 is associated with a cylinder 22 in which a percussion body 23 is also received for free motion. The drive piston and the percussion body act upon each other through penumatic buffer zone 24, in a manner such that the percussion body, after having impinged against the shaft 25 of a tool or tool holder 26, follows the rearward motion of piston 1 with a lag and reverses its direction of motion only after the air in the buffer zone 24, with the continuing working stroke of piston 1, is so strongly compressed that the pressure acting on the percussion body accelerates the same in the direction of the tool shank.

Cylinder 22 is provided with a shoulder 27 on its outer surface, in the form of a collar extending in the circumferential direction and concentrically of the cylinder axis. At the tool side, this shoulder rests against the front face of a housing part bearing bracket 28 and, at the drive side, it rests against the front face of a housing jacket 29. The position in space of cylinder 22 is thereby defined. During the assembly of the hammer drill, cylinder 22 is inserted into a receiving part 30 provided in housing jacket 29 and merely secured against rotation. This may be done, for example, by means of a pin which is secured to housing part 28 and engages a bore provided in shoulder 27. Cylinder 22 is centered by means of ribs 31 which are in contact with the outer surface of the cylinder.

Figure 2:
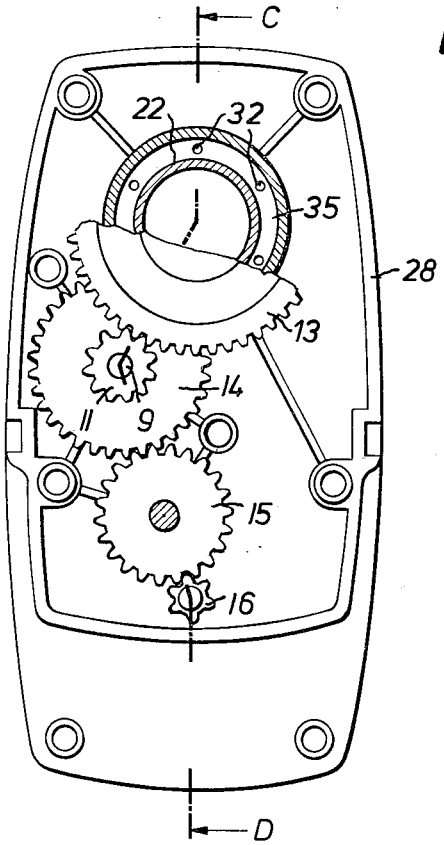
FIG. 2 is a sectional view taken along the line A–B of FIG. 1.

As shown particularly in FIG. 2, shoulder 27 of cylinder 22 is provided with a plurality of axial bores 32 which are arranged along the circumference of the shoulder. Bores 32 serve the purpose of permitting an equalization of the air pressure between chambers 35 and 36 which are defined between housing parts 28 and 33 and the housing jacket 29 and crank space 34.

The collar-shaped shoulder 27 is associated with a respective gasket ring 37 and 38 on each side in the zone where it applies against the adjacent front faces of the respective housing parts. This prevents air from escaping from chambers 35 and 36 to the outside. In order to obtain a satisfactory sealing against the tool, a stop disc 39 is provided for percussion body 23, which is received in a recess of spindle 12 and embraces shank 25 of the tool completely or partly, depending on the position thereof. Stop disc 39 is surrounded, with the interposition of a gasket ring 40, by a check disc 41 resting against the front face of the wall of cylinder 22.

An intermediate wall 42, in connection with a sealed-off bearing, i.e., RS bearing 43, separates the complete percussion mechanism, including crank space 34, hermetically from the lower part of the hammer drill.

Due to this design, an air exchange with the outer atmospheric air, as well as with the remaining interior of the hammer drill is prevented, and the absence of any appreciable lubricant leakage is also ensured.

Air openings 44 and 45 are provided in the cylinder wall for clearing an air flow communication from buffer zone 24 to chamber 35 in a manner controlled by percussion body 23. During the period of time in which air opening 44 is not covered by percussion body 23, air can pass through this opening into or from chamber 35, depending on whether drive piston 1 just executes a compression stroke or an expansion stroke (back stroke). Air opening 44 is provided in cylinder 22, in the buffer zone, at a location which is spaced from the driving piston in the forward dead-center position thereof and from the rear surface of percussion body 23 by a distance such that, with the percussion body in its impact position, the "re-supply" time during the back stroke of piston 1 is sufficiently long to securely prevent the percussion body from striking against the piston and to ensure an optimum percussion effect.

In case the percussion is switched off, air openings 45 become effective. For this purpose, either a tool having a shorter shank is inserted into the tool holder or, as in the present example, the tool holder with the tool is moved in the forward direction by means of an adjusting sleeve 46 and against the action of a return spring 47, into an arresting position, until shaft 25 of tool holder 26, which is nonrotably and axially displaceably guided in spindle sleeve 12, can move out of cylinder 22. Thereby, percussion body 23 is displaced so far in the forward direction that air openings 45 are cleared. This position of adjusting sleeve 46 and tool holder 26, which is provided with a key surface 59 for receiving a tool 58, is indicated in the lower half of the respective showing in FIG. 1. The consequence of this axial displacement of tool holder 26 is that no compression can build up any longer in cylinder 22, so that a hammering effect is suppressed and the tool executes only a rotary motion. The air displaced by percussion body 23 during the hammer drilling operation passes through openings 48 provided in the tool-side zone of cylinder 22 into chamber 35 and maybe into chamber 36 and, therefrom, during the rearward motion of percussion body 23 due to the developing underpressure, back into the front space of cylinder 22, thereby, supporting the rearward motion of the percussion body.

Spindle sleeve 12 is mounted by means of roller bearings 49 for rotation in a bushing 51 which is provided in the neck portion 50 of housing part 33. Resilient thrust elements in the form of cup springs 53 are provided between the rear face of bushing 51 and an enlargement of spindle sleeve 12.

FIG. 2, taken in connection with FIG. 1, shows that cylinder 22, intermediate shaft 9 and the motor shaft with pinion 16 are parallel to each other. This arrangement of these component parts, along with the use of a bevel gearing, contributes to the rugged construction of the inventive drill hammer.

Figure 3:
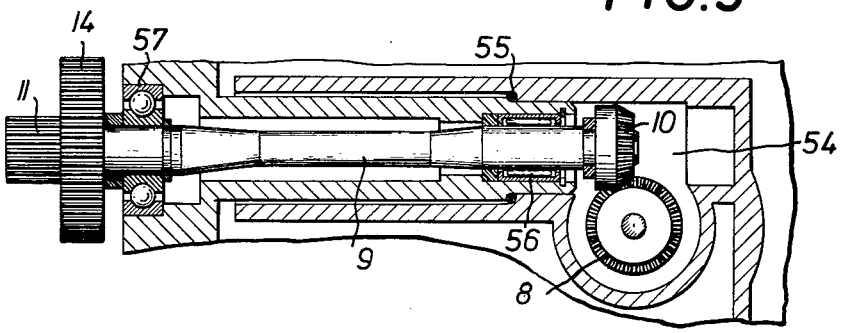
FIG. 3 is an enlarged sectional view taken along the line E–F of FIG. 1.

As seen from FIG. 3, the space 54 surrounding bevel gearing 8 and 10 is lubricant-tightly separated from the outside by means of a gasket ring 55. Intermediate shaft 9 is mounted in a roller bearing 56 alongside the bevel gearing 8 and 10 and, at the opposite end, the shaft is mounted in a grooved ball bearing 57. The shaft is made in one piece and, for reasons of torsion, is narrowed in its middle portion.

While a specific embodiment of the invention has been shown and described in detail to illustrate the application of the principles of the invention, it will be understood that the invention may be embodied otherwise without departing from such principles.

What is claimed is:

1. A hammer drill comprising a housing; a cylinder received in said housing and defining a cylindrical piston chamber; means defining an air chamber around at least a portion of said piston chamber sealed against the ambient atmosphere and against the adjacent component parts of said housing; said housing defining a tool-receiving chamber aligned and communicating with said piston chamber; a percussion body movable in said piston chamber against a tool in said tool-receiving chamber; a motor-driven piston reciprocable in said piston chamber relative to said percussion body; said cylinder also defining a pneumatic buffer zone between said piston and said percussion body, whereby air in said buffer zone provides a coupling and buffing fluid between said piston and said percussion body; a first air passage opening defined in said cylinder and interconnecting said air chamber and the interior of said cylinder in said buffer zone, said first air passage being spaced from said piston when said piston is in a forward dead-center position; said housing having a collar-receiving recess; a radially outwardly extending collar-shaped shoulder formed on said cylinder and extending across said air chamber and into the recess in said housing, said shoulder having air passages extending therethrough, and said shoulder determining the spatial position of said cylinder in said housing; and means form-lockably interengaging said housing and said cylinder to hold said cylinder in said housing against rotation.

2. A hammer drill, according to claim 1, wherein said collar-shaped shoulder air passage openings extend in an axial direction.

3. A hammer drill, according to claim 1, wherein said collar-shaped shoulder extends concentrically of said cylinder, said housing having a part on each side of said shoulder defining the recess therebetween into which said shoulder extends.

4. A hammer drill, according to claim 1, including a housing part arranged on each side of said shoulder and defining a shoulder-receiving recess therebetween, a gasket ring provided between each housing part and said shoulder.

5. A hammer drill, according to claim 1, wherein said cylinder has a front face, a check disc engaged against the front face of said cylinder, said tool-receiving chamber being defined at least partially by a cylindrical spindle sleeve having an enlargement portion in which said check disc is seated, a sealing and damping element disposed between said spindle sleeve and said check disc, a stop disc provided with a bore for a tool holder aligned with said spindle sleeve, said sealing and damping element surrounding said stop disc, said stop disc defining a tool passage bore.

6. A hammer drill, according to claim 1, including drive motor means connected to said piston to reciprocate said piston, said drive motor means including a cross-gear adjacent one end of said cylinder, said housing defining a space for said cross-gear and a lubricant-tightly closed seal sealing said space for said cross-gear.

7. A hammer drill, according to claim 1, wherein the cylinder-receiving part of said housing is formed with projecting ribs engaging the exterior surface of said cylinder to center said cylinder in said cylinder-receiving part of said housing.

* * * * *